US007389737B1

(12) United States Patent
Schwindaman

(10) Patent No.: US 7,389,737 B1
(45) Date of Patent: Jun. 24, 2008

(54) FOLDING TOP ASSEMBLY

(76) Inventor: Michael A. Schwindaman, 24141 North St., Cassopolis, MI (US) 49031

( * ) Notice: Subject to any disclaimer, the term of this patent is extended or adjusted under 35 U.S.C. 154(b) by 188 days.

(21) Appl. No.: 11/192,383

(22) Filed: Jul. 28, 2005

Related U.S. Application Data

(63) Continuation of application No. 11/148,073, filed on Jun. 8, 2005, now abandoned.

(51) Int. Cl.
*B63B 17/02* (2006.01)

(52) U.S. Cl. ..... 114/361; 135/88.01

(58) Field of Classification Search ..... 114/361, 114/285, 286; 296/107.1–107.2; 135/87–88.12
See application file for complete search history.

(56) References Cited

U.S. PATENT DOCUMENTS 3,195,549 A * 7/1965 Stevens ..... 114/361
6,209,477 B1 4/2001 Biedenweg
6,983,716 B1 * 1/2006 Ankney et al. ..... 114/361
7,100,964 B2 * 9/2006 MacNee, III ..... 296/117

* cited by examiner

*Primary Examiner*—Ed Swinehart
(74) *Attorney, Agent, or Firm*—Botkin & Hall, LLP

(57) ABSTRACT

A folding top assembly for watercraft of other vehicles includes a pair of struts pivotally mounted on actuator housings on opposite sides of the watercraft. The struts support a canvas covering and are moved by the actuators from a folded position in which the canvas covering and the struts are folded at the rear of the boat to an intermediate radar position in which the struts and canvas top are still folded against one another but are deployed in a raised position. One of the struts is maintained in the intermediate position when the top is moved into the fully deployed position, while the other strut is pivoted relative to the one strut. The actuators include a housing defining a bore therewithin, a piston or shuttle slidable in the bore, and a driving mechanism drivingly connecting the piston of each actuator with the struts so that movement of the piston in the bore pivots said struts relative to the piston.

16 Claims, 5 Drawing Sheets

FOLDING TOP ASSEMBLY

CROSS REFERENCE TO A RELATED APPLICATION

This is a continuation of application Ser. No. 11/148,073, filed Jun. 8, 2005 now abandoned.

TECHNICAL FIELD

This invention relates to a folding top assembly for watercraft.

BACKGROUND OF THE INVENTION

Deck, pontoon, and similar type boats are often equipped with a folding top, commonly referred to as a "bimini" top. The top includes struts that support a canvas cover over some or all of the occupants when the top is deployed in the fully opened position to shade the occupants from the sun and to provide limited protection of the occupants during inclement weather. The top may be folded against the rear of the boat on cool days when direct sun is desirable, but many users also deploy the top in a so-called "radar" position in which the top is folded, but the struts are deployed in an intermediate, angled position, thus providing for direct sun but also permitting easy access to all of the seats of the boat.

However, folding tops are relatively heavy and cumbersome, and are difficult to fold and deploy, especially for users having physical limitations. Accordingly, it is desirable to provide a power actuator for such folding tops, which enables users to easily move folding tops between the folded, radar and deployed positions. Although power actuators for such tops have been proposed before, such as in U.S. Pat. No. 6,209,477, none provides easy, powered movement between all three positions.

SUMMARY OF THE INVENTION

The present invention provides a folding top assembly which includes a pair of struts pivotally mounted on actuator housings on opposite sides of the boat. The struts support a canvas covering and are moved by the actuators from a folded position in which the canvas covering and the struts are folded at the rear of the boat to an intermediate radar position in which the struts and canvas top are still folded against one another but are deployed in a raised position. One of the struts is maintained in the intermediate position when the top is moved into the fully deployed position, while the other strut is pivoted relative to the one strut. The actuators include a housing defining a bore therewithin, a piston or shuttle slidable in the bore, and a driving mechanism drivingly connecting the piston of each actuator with the struts so that movement of the piston in the bore pivots the struts relative to the piston.

DESCRIPTION OF THE PREFERRED EMBODIMENT

Figure 1:
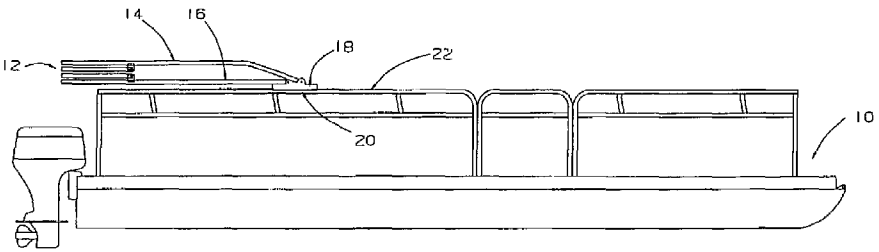
FIG. 1, FIG. 2 and FIG. 3 are each side elevation views of a typical watercraft having a folding top employing the present invention, the top being illustrated in the folded, radar and fully open positions respectively, the canvas cover having been omitted for clarity.
Figure 2:
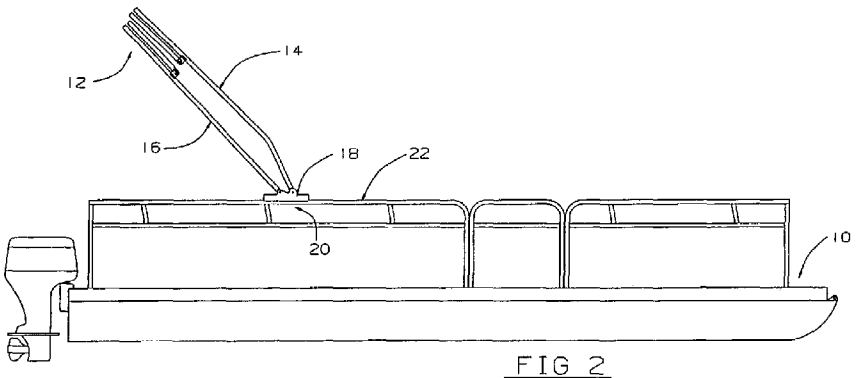
Figure 3:
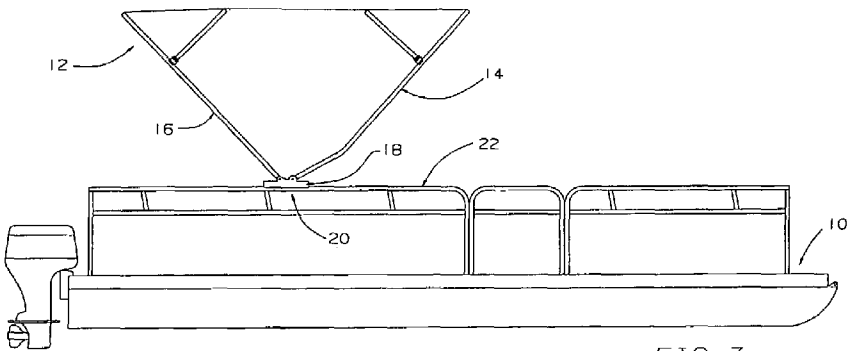

Referring now to the FIGS. 1-3, a typical pontoon boat employing the present invention is illustrated at 10, including a folding or bimini top generally indicated by the numeral 12. The top 12 includes a canvas cover (not shown), which is supported by a pair of primary front and rear struts 14, 16, each of which are pivotally mounted on a housing 18 of actuators 20 of the present invention. It will be noted that the struts 14, 16 are generally "U" shaped and bridge across the open deck of the boat 10, and that a pair of actuators 20 are each mounted on upper rail 22 on opposite sides of the boat and are operated simultaneously to fold and deploy the top 12. However, since the actuators are identical, only one will be described in detail.

The top 12 is illustrated in the fully retracted or folded position in FIG. 1. In this position, the folded top obstructs some of the seats at the rear of the boat. However, the top 12 can be moved from the folded position of FIG. 1 into an intermediate or "radar" position illustrated in FIG. 2. In this position, the top remains folded so that almost the entire deck is exposed, but the rear of the boat is not obstructed. The rear strut 16 remains locked in the position illustrated in FIG. 2 as the front strut 14 is pivoted away from rear strut 16 into the position illustrated in FIG. 3, in which the top 12 is in the fully deployed position.

Figure 4:
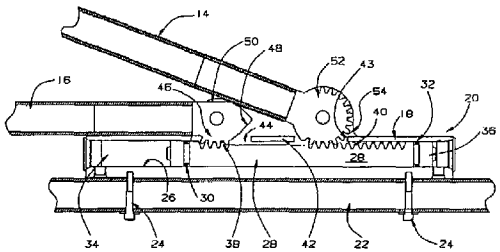
FIG. 4, FIG. 5 and FIG. 6 are enlarged, fragmentary cross sectional views of the lower portion of the struts illustrated in FIGS. 1-3 and a corresponding one of the actuators made pursuant to the present invention, illustrating the components in the folded, radar and fully open positions respectively.
Figure 5:
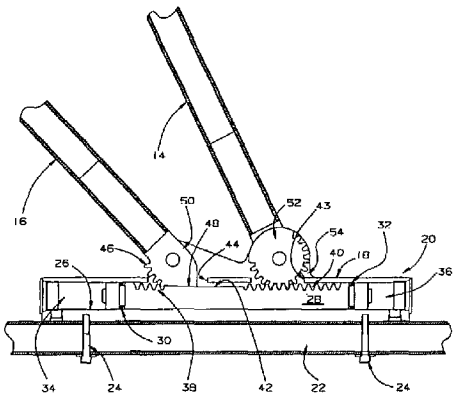
Figure 6:
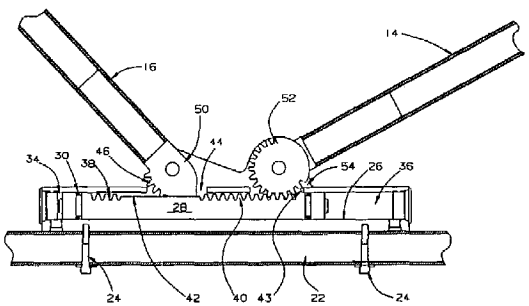

Referring now to FIGS. 4-6, The housing 18 is mounted on the top rail 22 by fasteners 24 and defines a bore 26 therewithin, which slidably receives a piston or shuttle 28. Circumferentially extending seals 30,32 circumscribe circumferential end portions of the piston 28 so that opposite ends of the piston 28 cooperate with corresponding ends of the bore 26 to define pressure chambers 34,36 therebetween. A pair of substantially flat, toothed racks 38,40 are defined on the piston or shuttle 28 and are separated by a substantially flat sliding surface 42. It will be noted that the rack 40 is substantially longer than the rack 38.

Slots 43,44 are defined in the housing 18 to receive a corresponding one of the struts 14,16. Strut 16 terminates in a driving mechanism including a gear sector 46 extending over a relatively small arc which engages the rack 38 when the is strut 16 is being moved between the fully folded and the radar positions. A substantially flat sliding surface 48 extends from the gear sector 46 and is shaped to slidably engage the sliding surface 42 on the piston 28 after the strut 16 has been rotated into a predetermined angular orientation. Strut 16 is pivotally connected to a projecting ear 50 on housing 18 adjacent the slot 44. Strut 14 terminates in a driving mechanism including a gear sector 52 that extends over an arc substantially greater than the arc defined by gear sector 46 on the strut 16. Gear sector 52 engages the rack 40, and both the rack 40 and gear sector 52 are of sufficient length that the strut 14 can be rotated from the fully folded to the fully open or deployed positions. Strut 14 is pivotally connected to a projecting ear 54 on housing 18 adjacent the slot 42.

As discussed above, the struts 14,16 are illustrated in FIG. 4 in the positions they assume when the top 12 is in the fully folded position illustrated in FIG. 1. When it is desired to raise the top, the shuttle or piston 28 is moved to the left viewing the FIGURES, thereby rotating the struts 14 and 16 clockwise through substantially the same are until the struts 14 and 16 are rotated into a predetermined angular position illustrated in FIG. 5 which represents the radar position of the top 12 illustrated in FIG. 2. Since both struts are rotated through the same arc, the top remains folded. As the piston 28 is moved past the FIG. 5 position, the sliding surface 48 engages the sliding surface 38 on the piston 28, to thereby lock the strut 16 in the predetermined angular position while permitting the strut 14 to continue to rotate, due to its remaining in driving engagement with the rack 40. Accordingly the strut 14 is rotated into the fully opened position illustrated in FIGS. 6 and 3 while the strut 16 remains locked in the predetermined angular position. When the operator desires to fold the top, the piston 28 is moved to the right, thereby folding the strut 14 back into the FIG. 5 position before both struts are rotated together back to the fully folded position.

Figure 7:
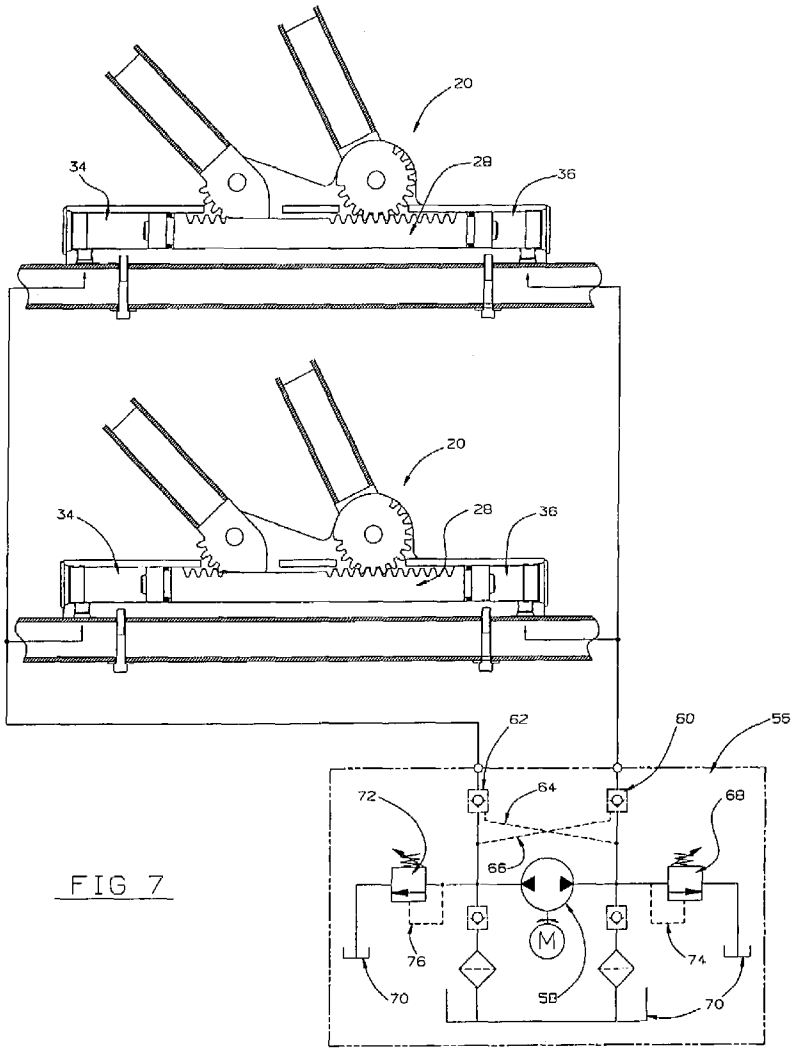
FIG. 7 is a cross sectional view of both actuators illustrated in a hydraulic schematic diagram illustrating the manner in which the actuators of the present invention are powered.

The piston may be moved hydraulically or mechanically. The hydraulic system illustrated in FIG. 7 may be used to pressurize one of the chambers 36 or 34 and vent the other chamber to reservoir to drive the piston 28 in the desired direction. In FIG. 7, the actuators 20 on opposite sides of the boat are both illustrated. A hydraulic system generally indicated by the numeral 56 includes a reversible hydraulic pump 38, one side of which is connected to chambers 36 of the actuators 20 through pilot operated check valve 60 and to the chambers 34 through pilot operated check valve 62. Check valves 60, 62 normally check flow in the direction indicated in the absence of a pressure signal in the corresponding pilot pressure line 64, 66. Electrically actuated valve 68 controls communication between chambers 36 and the reservoir 70, and electrically actuated 72 controls communication between the chambers 34 and the reservoir 70. The pump 58 draws fluid from the reservoir 70 and communicates pressure either through check valve 60 or check valve 62, depending upon the direction the pump is driven. When the pump is driven in the direction pressurizing chamber 36, valve 68 is closed and valve 72 is open, thereby venting chambers 34 to reservoirs, the check valve 62 being held open by pilot pressure in the line 64. Accordingly, the piston 28 is driven to the left, deploying the top. When it is desired to fold the top, valve 72 is closed, valve 68 is opened, and the pump is driven in the direction pressurizing chambers 34 through check valve 62, check valve 60 being held upon by pressure in pilot line 66, to permit pressure to vent from the chambers 36. When it is desired to hold the top in the folded, radar, or open position (or any position in between), the pump is turned off and both valves 72 and 68 are closed, thereby holding pressure in both chambers 34 and 36. The valves 68 and 72 are provided with pressure reliefs 74 and 76, to limit the pressures in the chambers 34 and 36. The reliefs 74 and 76 may be set differently, so that a lower pressure is used to move the top from the open to the folded position than from the open to the folded position, since the weight of the top assists in moving the top to the folded position.

Figure 8:
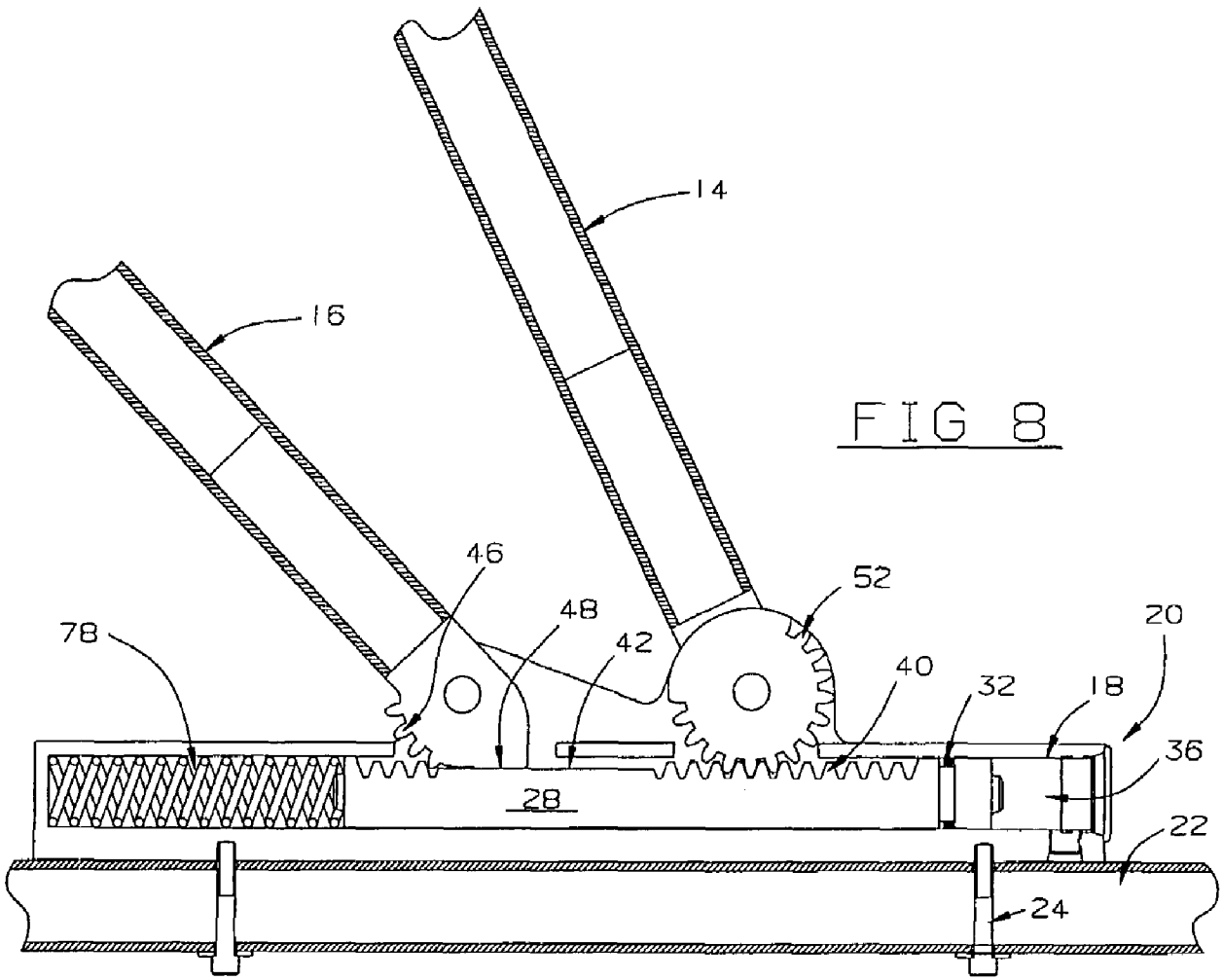
FIG. 8 and FIG. 9 are views similar to FIG. 5 but illustrating alternate embodiments of the invention.
Figure 9:
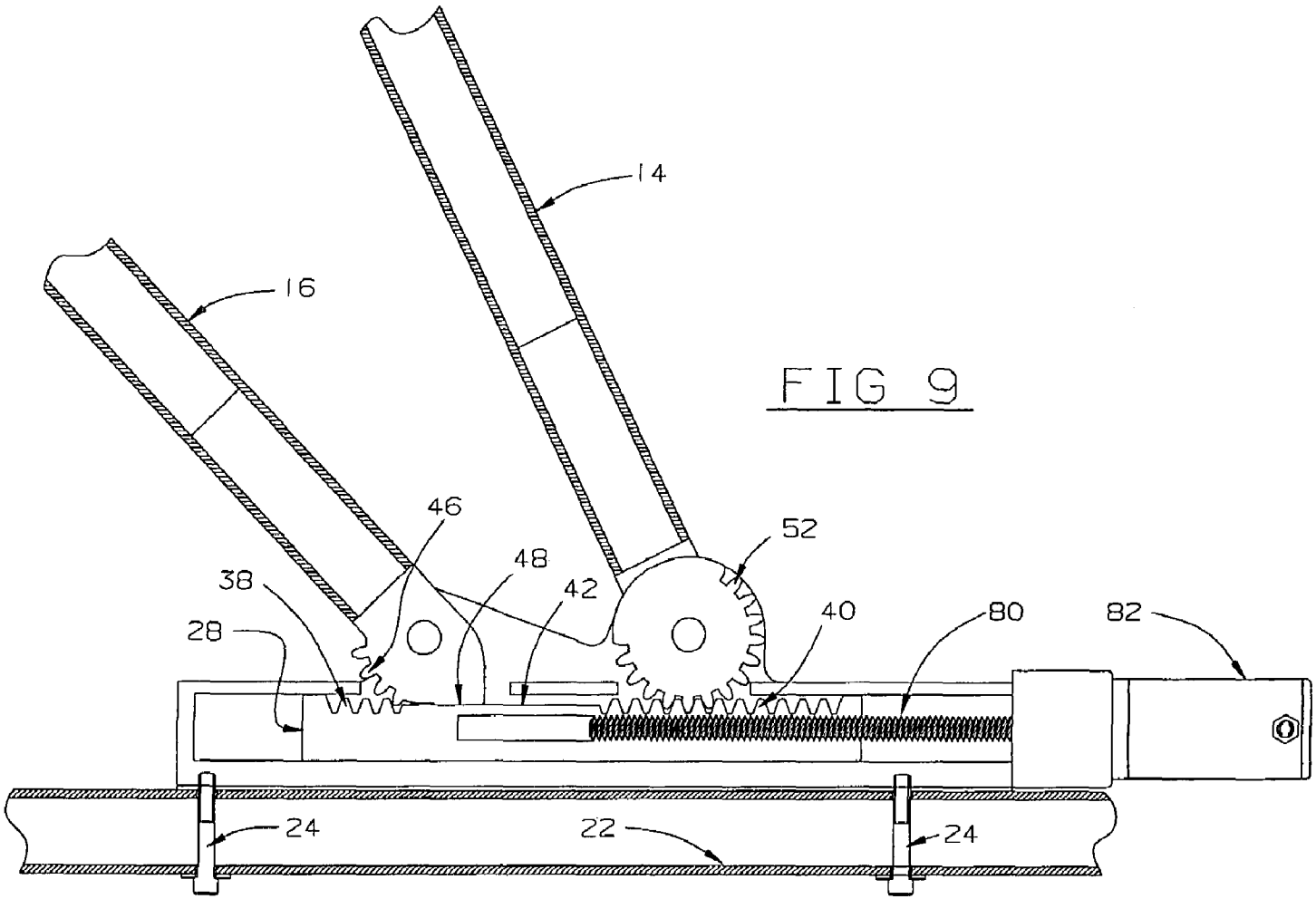

Referring to the alternate embodiment of FIG. 8, a spring 78 may be used in chamber 34 to bias the piston 38 to the open position, fluid pressure only being used to move the top to the folded position. The top may be biased toward the folded position by placing the spring in chamber 36 and using fluid pressure in chamber 34 to move the top to the open position. Referring to the embodiment of FIG. 9, the piston 28 includes a threaded portion that is threadedly engaged with a jack-screw 80 which is turned by a bi-directional electric motor 82 to move the piston or shuttle 28, to thereby move the top 12 between the folded and open positions.

The invention claimed is:

1. Folding top assembly comprising a pair of struts pivotally mounted for pivotal movement relative to one another, a canvas covering supported by said struts, and an actuator for moving said struts from a folded position folding said canvas covering to an open position in which the canvas covering is deployed to cover at least a portion of the vehicle, said actuator including a housing defining a bore therewithin, a piston slidable in said bore, a driving mechanism drivingly connecting the piston with the struts whereby movement of the piston in said bore pivots said struts relative to the piston to move the struts between the folded and open positions as the piston is moved within the bore, and an actuating mechanism for moving said piston, said driving connection including gears carried by said struts engaging a toothed rack defined on said piston.

2. Folding top assembly as claimed in claim 1, wherein said housing defines slots exposing said toothed rack, said struts extending through said slots to engage their corresponding gears with said toothed rack.

3. Folding top assembly as claimed in claim 2, wherein said toothed rack includes a pair of toothed segments and a sliding surface between the toothed segments, one of said gears having a toothed section and a sliding section slidably engaging said sliding surface on the piston after the one gear and its corresponding strut is pivoted to a predetermined position.

4. Folding top assembly as claimed in claim 3, wherein said sliding surface and said sliding section are substantially flat mating surfaces to thereby hold the corresponding strut in a predetermined angular position.

5. Folding top assembly as claimed in claim 4, wherein said actuating mechanism includes a source of hydraulic pressure, said piston cooperating with said bore to define a pressure chamber, and valve means controlling communication between said pressure chamber and said source to move said piston in said bore.

6. Folding top assembly as claimed in claim 4, wherein said actuating mechanism includes a threaded screw threadedly engaged with said piston, and means for selectively rotating said screw to thereby move the piston within said bore.

7. Folding top assembly comprising a pair of struts pivotally mounted for pivotal movement relative to one another, a canvas covering supported by said struts, and an actuator for moving said struts from a folded position folding said canvas covering to an open position in which the canvas covering is deployed to cover at least a portion of a vehicle, said actuator including a housing defining a bore therewithin, a piston slidable in said bore, a driving mechanism drivingly connecting the piston with the struts whereby movement of the piston in said bore pivots said struts relative to the piston to move the struts between the folded and open positions as the piston is moved within the bore, and an actuating mechanism for moving said piston, said driving mechanism including driving couplings between each of said struts and said piston pivoting said struts relative to the housing as the piston slides in the bore, one of said driving couplings including a driving portion pivoting the corresponding strut as the piston slides in the bore until the corresponding strut attains a predetermined angular position relative to the housing and a locking portion maintaining said one strut in said predetermined angular position as the piston continues movement within the bore.

8. Folding top assembly as claimed in claim 7, wherein the other of said driving couplings includes a driving portion pivoting the other strut relative to the housing during additional movement of the piston after the one strut is pivoted to said predetermined angular position.

9. Folding top assembly as claimed in claim 8, wherein said driving portion of said one coupling is a toothed segment engaging a correspondingly toothed segment of said piston and said locking portion is a surface slidably engaging a corresponding surface on said piston.

10. Folding top assembly comprising a pair of struts pivotally mounted for pivotal movement relative to one another, a canvas covering supported by said struts, and an actuator for moving said struts from a folded position folding said canvas covering to an open position in which the canvas covering is deployed to cover at least a portion of a vehicle, said actuator including a shuttle, drive means connecting said shuttle to said struts for pivoting both of said struts into a predetermined angular position, locking one of said struts in said predetermined angular position, and pivoting the other strut relative to said one strut from said predetermined angular position into said open position.

11. Folding top assembly as claimed in claim 10, wherein said shuttle is slidable in a housing, said struts being pivotally mounted on said housing.

12. Folding top assembly as claimed in claim 10, wherein said drive means includes cooperating connecting means connecting said shuttle with said struts, said drive means further including locking means for holding said one strut in said predetermined angular position while permitting said shuttle to slide relative to said one strut.

13. Folding top assembly as claimed in claim 12, wherein said cooperating connecting means includes toothed arcuate segments on said struts engaging a toothed segment on said shuttle for pivoting said struts in response to sliding of the shuttle.

14. Folding top assembly as claimed in claim 12, wherein said cooperating connecting means includes a toothed arcuate segment on said one strut engaging a correspondingly toothed segment of said shuttle, and a sliding surface on said one strut slidably engaging a sliding surface on said shuttle to permit said shuttle to slide relative to said one strut as said one strut is locked in said predetermined angular position.

15. Folding top assembly as claimed in claim 10, wherein said shuttle is moved by hydraulic pressure.

16. Folding top assembly as claimed in claim 10, wherein said shuttle is moved by a threaded screw threadedly engaged with said shuttle, and means for selectively rotating said screw.

* * * * *